US005319282A

United States Patent [19]

Winsor

[11] Patent Number: 5,319,282

[45] Date of Patent: Jun. 7, 1994

[54] PLANAR FLUORESCENT AND ELECTROLUMINESCENT LAMP HAVING ONE OR MORE CHAMBERS

[76] Inventor: Mark D. Winsor, 314½ Capitol Way North, Olympia, Wash. 98501

[21] Appl. No.: 816,034

[22] Filed: Dec. 30, 1991

[51] Int. Cl.[5] ..... G09G 3/10

[52] U.S. Cl. ..... 315/169.4; 313/493; 313/492; 313/503; 313/639; 313/574; 313/573; 313/631; 315/169.3

[58] Field of Search ..... 315/169.1, 169.4, 169.3; 313/493, 492, 485, 491, 502, 503, 489, 568, 639, 574, 573, 631, 17, 22, 25, 35, 36

[56] References Cited

U.S. PATENT DOCUMENTS

| | | | |
|---|---|---|---|
| 2,733,368 | 1/1956 | Kolkman | 313/596 |
| 2,900,545 | 8/1959 | Rulon et al. | 313/108 |
| 3,047,763 | 7/1962 | Inman | 313/109 |
| 3,121,184 | 2/1964 | Fox | 313/492 |
| 3,258,630 | 6/1966 | Scott | 313/493 |
| 3,508,103 | 4/1970 | Young | 313/109 |
| 3,646,383 | 2/1972 | James et al. | 313/109 |
| 3,967,153 | 6/1976 | Milke et al. | 313/489 |
| 4,079,288 | 3/1978 | Maloney et al. | 313/489 |
| 4,117,374 | 9/1978 | Witting | 315/99 |
| 4,234,817 | 11/1980 | Teshima et al. | 313/493 |
| 4,245,179 | 1/1981 | Buhrer | 315/248 |
| 4,266,167 | 5/1981 | Proud et al. | 315/248 |
| 4,312,028 | 1/1982 | Hamacher | 313/493 |
| 4,363,998 | 12/1982 | Graff et al. | 313/487 |
| 4,575,656 | 3/1986 | Anderson, Jr. et al. | 313/492 |
| 4,698,547 | 10/1987 | Grossman et al. | 313/485 |
| 4,710,679 | 12/1987 | Budinger et al. | 313/493 |
| 4,767,965 | 8/1988 | Yamano et al. | 313/491 |
| 4,772,819 | 9/1988 | Ridders | 313/493 |
| 4,803,399 | 2/1989 | Ogawa et al. | 313/493 |
| 4,839,555 | 6/1989 | O'Mahoney | 313/493 |
| 4,851,734 | 7/1989 | Hamai et al. | 313/485 |
| 4,899,080 | 2/1990 | Vriens et al. | 313/22 |
| 4,916,352 | 4/1990 | Haim et al. | 313/25 |
| 4,916,356 | 4/1990 | Ahern et al. | 313/336 |
| 4,916,359 | 4/1990 | Jönsson | 313/489 |
| 4,920,298 | 4/1990 | Hinotani et al. | 313/493 |

OTHER PUBLICATIONS

Mercer et al., "Fluorescent backlights for LCDs," *Information Display,* Nov. 1989, pp. 8-13.

Sanyo Electric Co., Ltd., "Flat Fluorescent Lamp Specifications." dated before the date of applicant's invention.

Hinotani et al., *1988 International Display Research Conference,* "Flat Fluorescent Lamp for LCD Back--Light."

*Primary Examiner*—Robert J. Pascal
*Assistant Examiner*—Michael B. Shingleton
*Attorney, Agent, or Firm*—Seed and Berry

[57] ABSTRACT

A planar fluorescent and electroluminescent lamp having two pairs of electrodes. Planar electrodes on an outer surface of the lamp create a plasma arc by capacitive coupling. The planar electrodes also cause embedded phosphor to emit light on the electroluminescent phenomena. In one embodiment, a second chamber is on top of the first chamber and light passes from a primary chamber through the second chamber, and is emitted by the lamp.

15 Claims, 8 Drawing Sheets

PLANAR FLUORESCENT AND ELECTROLUMINESCENT LAMP HAVING ONE OR MORE CHAMBERS

FIELD OF THE INVENTION

This invention relates to planar fluorescent lamps, and more particularly, to a planar fluorescent lamp having two pairs of electrodes and which emits light by both fluorescent and electroluminescent phenomena.

BACKGROUND OF THE INVENTION

Thin, planar, and relatively large area light sources are needed in many applications. Backlights must often be provided for LCDs to make them readable in all environments. Thin backlights for LCDs are desired to preserve as much as possible the LCDs' traditional strengths of thin profile, low cost, and sunlight readability while permitting readability at numerous angles and in low light conditions. Lamps for use in the avionics environment, such as airplane cockpits, are preferably as lightweight, thin, and low power as possible.

Many demanding challenges exist for engineering a thin, planar source of uniform light. If incandescent lamps or LEDs are used as the light source, the optics for dispersing and diffusing light from the multiple point sources to the planar viewing surface must be provided to avoid local bright or dim spots. Additionally, provision must be made to dissipate the heat generated by the incandescent or LEDs, or alternatively, to utilize only high-temperature materials for LCDs.

Recent developments in large LED arrays have made them appear suitable for use in flat panel displays. However, arrayed LEDs still consume relatively high amounts of power and require careful attention to avoid the thermal effects from the LEDs. Furthermore, the problems of diffusing the light emitted by the LED arrays must still be overcome as well as the spectral limitations inherent in an LED.

The introduction, some thirty years ago of electroluminescent lamps, is a possible choice for a planar lamp. Unfortunately, electroluminescent lamps suffer from a short life at high frequencies and have low ultimate brightness at about one lumen per watt. Nevertheless, the electroluminescent lamp is sometimes selected as a solution to low light display outputs, despite its spectral limitations and intrinsic problems with life expectancy.

Another choice for generating light for a display is fluorescent technology. Fluorescent lamps have the advantage of being relatively efficient and capable of generating sufficiently bright light. Miniature fluorescent lights made for backlights are typically tubular structures having selected diameters and lengths. Backlighting schemes using tubular fluorescent lamps generally require a reflector and a diffuser to distribute the light. The additional weight and size of the light-directing components, when added to the bulb volume, result in a bulky package usually exceeding one inch in thickness. Furthermore, miniature fluorescent tubes are inherently very fragile and more costly to produce than the large-sized commercial counterparts. Despite the significant drawbacks of fluorescent tubes, they are often chosen to provide the backlighting required in today's LCD displays or aircraft cockpits.

Planar fluorescent lamps are well known in the art. Envelopes are formed by sealing molded glass pieces together along their edges. Some prior art planar lamps include labyrinthine discharge channels. See, for example, U.S. Pat. Nos. 3,508,103; 3,646,383; and 3,047,763. Because of the complex glass molding and stamped metal housings, the prior art fluorescent flat panels are difficult to manufacture and expensive. These lamps had nonuniform light intensity ouput across the lamp and were often too thick and too inefficient for portable computer screens using batteries.

One flat fluorescent lamp, as shown in U.S. Pat. No. 4,851,734 ('734), utilizes transparent electrodes on planar glass plates. Unfortunately, the narrow gap between the plates constricts the length of the positive column, resulting in low ultraviolet radiation and low illumination. Further, in the embodiment with the electrodes on the outside, the usable power is reduced because the glass must be sufficiently thick to withstand normal atmospheric implosion when the chamber is vacuum-evacuated. In the embodiment shown in FIG. 4 of the '734 patent, the electrodes are directly, exposed to each other, with no insulating layer in-between, severely limiting their practical use. Further, the unprotected transparent thin-film electrodes sputter away very quickly from ionic bombardment within a fluorescent tube.

A flat fluorescent lamp designed for LCD backlighting is disclosed in U.S. Pat. No. 4,767,965. Two parallel glass plates are supported by a framepiece, including two cold cathode electrodes placed opposite each other. A plasma discharge at the optimum mercury vapor pressure ranges conducts current as an arc and no in a planar fashion. This results in a discharge which is nonuniform in the planar chamber and brightness variations as great as 60% across the face of the lamp. In addition, these parallel glass plates must be thick to avoid atmospheric implosion when a vacuum is drawn in the envelope.

Some problems of the prior art have been attempted to be overcome by using a combination of a hot cathode surrounded by a cold cathode in tubular fluorescent lamps as taught in U.S. Pat. Nos. 4,117,374 and 3,883,764. These lamps are designed for large currents and are opaque to visible light, thus exhibiting nonuniform dark areas at the lamp envelope ends.

A need remains for a planar lamp that is thin in cross-section and uniformly bright across the entire face thereof.

SUMMARY OF THE INVENTION

According to principles of the present invention, a planar fluorescent lamp includes a pair of planar electrodes on an inside surface of the vacuum chamber. At least one of the planar electrodes is transparent to visible light. A thin dielectric layer completely covers each of the electrodes within the chamber. The chamber is evacuated and refilled with an inert gas to a selected pressure. Mercury vapor is placed therein to permit fluorescent illumination from the phosphor layers. The dielectric layers capacitively couple the high frequency power source across the low-pressure chamber for creating a plasma which emits ultraviolet radiation.

In one embodiment, two pairs of electrodes are provided: one pair of planar electrodes and one pair of individually driven by a different power source. The power sources are preferably at different frequencies. Alternatively, the power sources are at the same frequency, but out of phase with each other by exactly 90° to ensure the electrical separation of each power source.

In one embodiment, the chamber has walls therein to provide a serpentine, elongated discharge column. It is generally known that the length of the discharge path is one of the factors in determining the light output, and the longer the discharge path, the greater the output and the luminous efficiency, according to Pascend's law. It is also known that in low-pressure, positive-column lamps with phosphors excited by mercury radiation, it is possible to obtain improved efficiency and greater output when the discharge column is constructed out of round. Accordingly, the serpentine, thin-film cavity is segregated by planar wall members with an electrode at each end of the serpentine chamber.

In one embodiment, the phosphor includes a combination of fluorescent phosphors and electroluminescent phosphors. The electroluminescent phosphors emit light directly into the glass plates when an electric field is applied. The light emitted by the electroluminescent phosphors is generally uniform across the lamp. The light emitted by the fluorescent phosphors provides the desired high brightness.

The planar lamp may include a total of two, three, or more chambers, if desired, according to one embodiment. The upper chamber is positioned on top of the lower chamber such that any light exiting from the lower chamber must pass through the upper chamber. In one embodiment, the upper chamber or chambers are vacuum-evacuated and phosphor-lined to emit light when ultraviolet radiation from the primary chamber impinges thereon. The top glass of the lower chamber is thin to permit the ultraviolet mercury radiation to pass through it and enter the upper chamber as well. Alternatively, the upper chamber is filled with a cooling liquid to maintain the overall temperature of the lamp at a selected value. Still alternatively, the upper chamber is open to the atmosphere, and air-filled to permit cooling air to pass therethrough and evenly disburse the light prior to output from the lamp.

The phosphor layer of the emission chamber is preferably very thin and is crystallized into the glass dielectric layer itself. The glass dielectric layer is preferably lead-free so as to not degrade the phosphor. A glass is selected which has a reflow temperature of approximately 600° C. and preferably well below the 700° C. at which phosphor begins to degrade.

The phosphor is applied to the glass in a slurry and the combination heated until the glass becomes somewhat sticky and wet, as would occur at approximately the reflow temperature of the glass. The glass with the phosphor coating in place is then cooled to form phosphor crystals embedded into the glass layer itself. In the final product, portions of phosphor crystals are embedded in and surrounded by glass and portions of the phosphor crystals are exposed to the mercury chamber itself. Light efficiently passes directly from the phosphor crystals into the glass for emission while minimizing the reflectance of the light from the phosphor glass interface. In addition, the light is also emitted based on electroluminescence directly from the phosphors and into the glass.

DETAILED DESCRIPTION OF THE INVENTION

Figure 1:
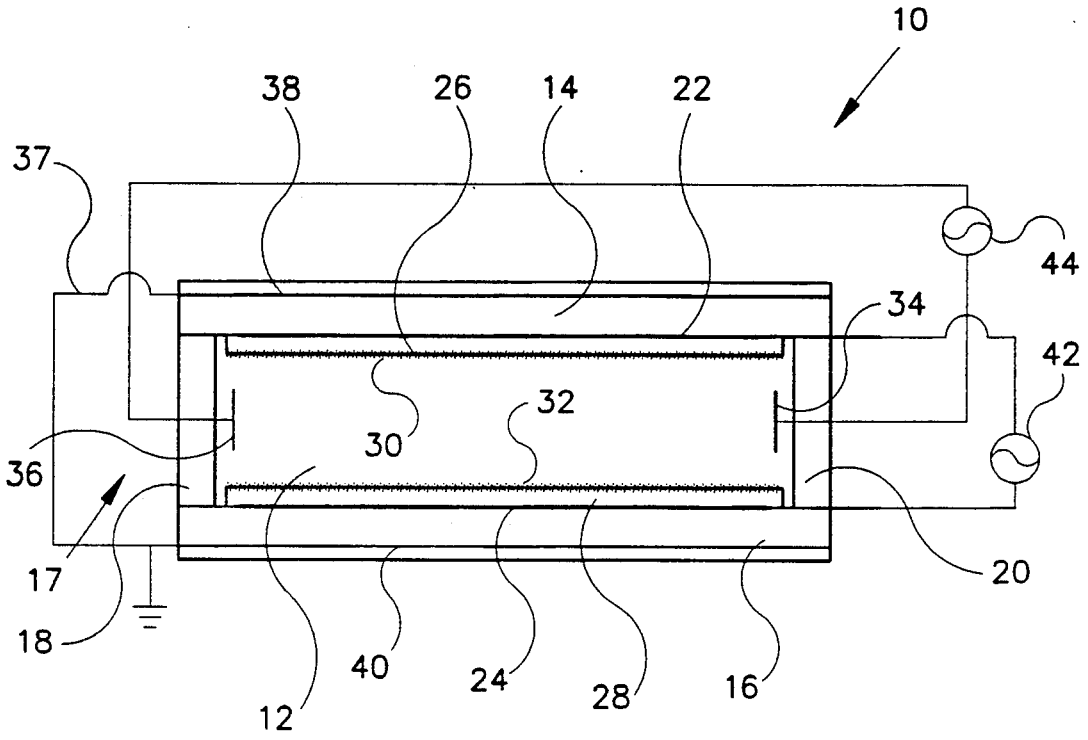
FIG. 1 is a cross-sectional view of a planar lamp according to one embodiment of the invention.

FIG. 1 illustrates a lamp 10 having a chamber 12. The chamber 12 is formed by the sealed enclosure of a pair of planar plates top plate 14 and bottom plate 16 and a sidewall structure 17 having a pair of sidewalls 18 and 20. A pair of planar electrodes 22 and 24 are on an inner surface of the planar plates 14 and 16, respectively. At least one of the planar electrodes 22 and 24 is transparent to permit light to exit from the chamber 12. Conductive wire mesh or other known conductive transparent conductor can be used, such as those taught in U.S. Pat. Nos. 4,266,167 ('167) or 4,851,734 ('734), both incorporated herein by reference. The planar electrodes 22 and 24 extend over the majority of the inner surface of the plates 14 and 16 of the chamber 12.

Dielectric glass layers 26 and 28 overlie planar electrodes 22 and 24, respectively. At least one, and usually both, of the dielectric layers 26 and 28 are transparent. In one embodiment, the dielectric layers are soda-lime, lead-free ceramic glass having the desired temperature characteristics as described herein. Overlying the dielectric layers 26 and 28 are phosphor layers 30 and 32, respectively. Known phosphors are suitable for layers 30 and 32, as explained in the patents incorporated by reference; alternatively, the phosphors may be specifically formulated and applied as explained more fully herein.

The chamber 12 is filled with an ionizable atmosphere that produces ultraviolet radiation when electrically excited. A gas or mixture of inert gases from group 0 of the periodic table, for instance, argon at a low pressure, and mercury vapor having a partial pressure in the range of 1–10 microns, form the atmosphere within chamber 12. Generally droplets of mercury in the liquid state are within the chamber 12 and a portion of the chamber 12 is held in the temperature range of 40° C.–50° C. to produce mercury resonance radiation in the range of 2537 A. As is known, the mercury vapor pressure is determined by the coolest portion of the chamber 12 and it is not necessary for the entire chamber 12 to be at this temperature, so long as a part of it is. Ultraviolet radiation emitted by the plasma within the chamber 12 causes the phosphor layers 30 and 32 to emit viewable, white light according to known fluorescent lamp phenomena.

The phosphor layers 30 and 32 on the inside of the chamber 12 convert the ultraviolet light created by these two power sources into longer, visible light at high efficiencies. Light is emitted from both the top and bottom of the lamp 10 when all planar electrodes are transparent. Alternatively, light is reflected from the bottom and is emitted only from the top, as shown in other embodiments herein.

A pair of internal cathodes 34 and 36 are also positioned within the chamber 12. The internal cathodes may be of the extended bar type shown in U.S. Pat. No. 4,767,965, or the shorter type as shown in U.S. Pat. No. 3,508,103, both incorporated herein by reference. Preferably, the internal cathodes 34 and 36 are of the flat sheet type shown in FIGS. 9–11 and explained later herein. The internal cathodes 34 and 36 can be of the hot cathode type, the cold cathode type, or the combination hot and cold cathode type, as explained in more detail herein. Thus, the term "vertical electrode" refers to the type of electrode, one that is within the chamber 12 to create an electron flow within the gas, and not to a particular shape of electrode.

An electric ground shield 37 having electrodes 38 and 40 may also be provided, if it is desired, to block any electric fields which the lamp 10 may generate outside of itself. The ground shield 37 may be omitted if desired.

Power is applied simultaneously to planar electrode pairs 22, 24 and vertical electrode pairs 34, 36 to cause the lamp 10 to emit light. An AC power supply 42 powers planar electrodes 22 and 24. A separate AC power supply 44 powers internal cathodes 34 and 36. The AC power supplies 42 and 44 may be of the high-frequency type as disclosed in the '167 patent or of a low-frequency type as used in standard fluorescent lamps today. The two power supplies 42 and 44 preferably are at different frequencies to ensure that the electrodes do not short to an electrode not in their pair. Typically, drive frequencies are in the range of 400–2000 Hz at 700 volts. In one embodiment, the drive frequency is at 25 kHz at 700 volts, but only 13 watts of power is required, thus resulting in very low current. If power supplies 42 and 44 are the same frequency, they are set 90° out of phase to minimize the interference between them. In one embodiment, the power supplies 42 and 44 are provided from a single power source but circuitry electrically separates it into two power supplies and offsets their phase by 90°. (For example, a DC power supply can be converted to AC power at the selected frequency for power supplies 42 and 44.) Having the AC power sources 42 and 44 90° out of phase with each other ensures that the planar electrodes 22 and 24 act as one pair and the internal cathodes 34 and 36 act as a separate pair. Driving each pair of electrodes with a separate power source and 90° out of phase ensures that the respective pairs operate independent of each other.

The planar electrodes 22, 24 create an electric field by capacitive coupling, causing excitation of the plasma in primary chamber 12. The electrodes 22 and 24 are plates of a capacitor and the dielectric layer of the capacitor is the combination of the dielectric layers 26 and 28 and the atmosphere within the chamber 12. In one embodiment, only a single electrode, either 22 or 24 is covered with a dielectric and the other electrode is not so coated. Having a single electrode coated is suitable, though having both uniformly coated with exactly the same thickness of dielectric layers 26 and 28 is preferred. The excitation of a mercury plasma by capacitive coupling produces a stable and uniform plasma and a uniform source of ultraviolet light, a condition conducive to uniform light generation.

On the other hand, the internal cathodes 34 and 36 create an electric discharge when the voltage across the internal cathodes 34 and 36 rises above a threshold value, called the breakdown voltage, creating a positive column. The discharge arc is sustained by a flow of electrons emitted by the cathode and collected by the anode. In AC operation, the electrodes at both ends are identical and operate alternatively as the cathode and anode. The phenomenon, known as space charge effect, produces a voltage drop across the lamp causing the atmosphere in the chamber 12 to conduct, which accelerates electrons, thus changing the electrical energy into kinetic energy. Mercury atoms emit high amounts of ultraviolet light in this plasma.

The two pairs of electrodes operate simultaneously to produce a bright and highly uniform light source. Each phenomenon compliments the other to overcome the respective weak points. For example, an arc discharge is known to produce high light output with great efficiency, that is, many lumens per watt. However, plasma discharge at optimum mercury pressure conducts as an arc and is often not a uniform discharge over a large surface area. As a result, nonuniformities of brightness exist across the face of prior art lamps between the internal cathodes. Planar capacitive electrodes 22 and 24 act to create very uniform plasma across the entire chamber 12. This complements the high light output capability of the internal cathodes 34 and 36. The shape of the plasma between internal cathodes 34 and 36 is altered to be more uniform by the horizontal electrodes to create a highly uniform, high light output arc across the entire chamber.

The horizontal electrodes also act to reduce the space charge effect, thus causing a corresponding reduction in voltage drop which yields a higher phosphor life and overall efficacy.

A highly uniform light output across a thin, planar, rectangular lamp permits it to be used in a wide variety of applications. This lamp can be used as backlighting for LCD screens on computers, avionic displays, signs, or the like. In addition, many lamps can be coupled together, edge-to-edge, to form a large area, uniform light output source for large signs or other uses.

Figure 2:
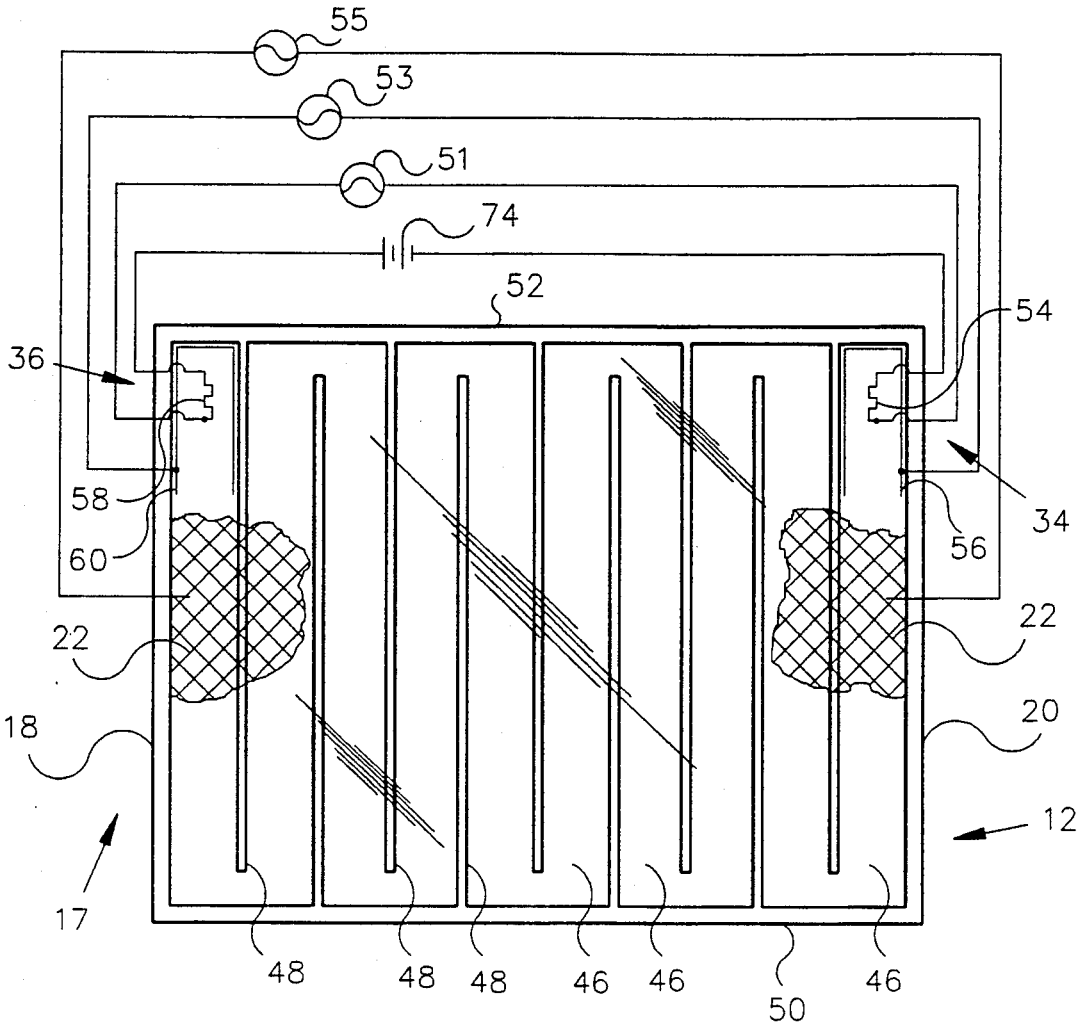
FIG. 2 is a top cross-sectional view of an alternative embodiment having a serpentine discharge chamber.
Figure 3:
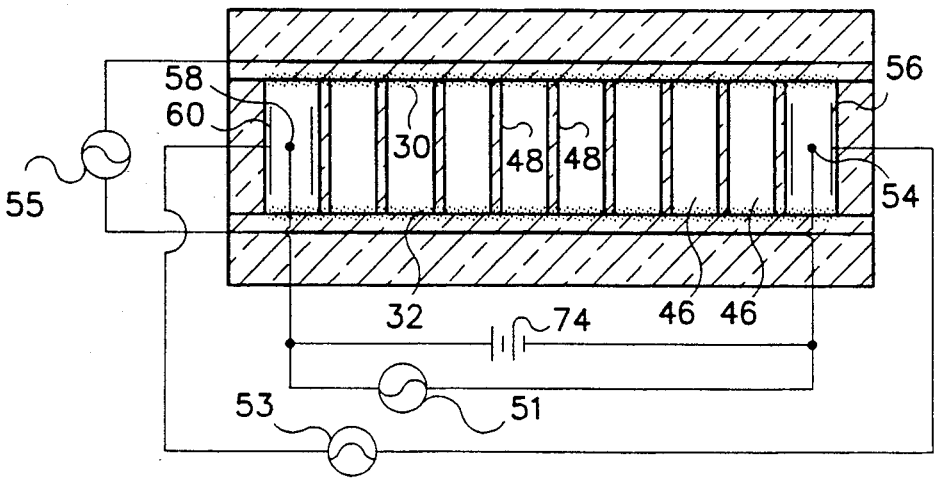
FIG. 3 is a side cross-sectional view taken along lines 3—3 of FIG. 2.
Figure 4:
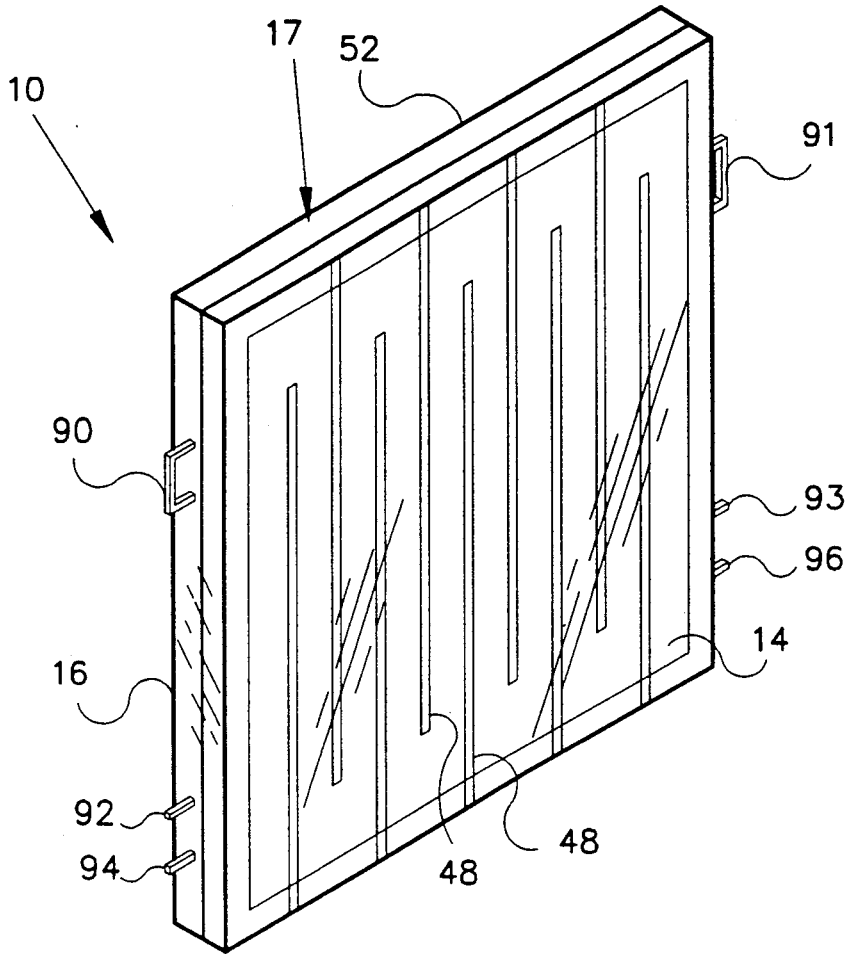
FIG. 4 is an isometric view of the alternative embodiment of FIG. 2.

FIGS. 2–4 illustrate an alterative embodiment of the planar lamp 10 having interior walls 48.

As shown in FIG. 2, internal cathodes 34 and 36 are positioned at each end of a discharge column 46. The discharge column 46 extends as a single, narrow column from electrode 34 to electrode 36 in serpentine fashion, that is, bending back and forth. Walls 48 within the chamber 12 are sealed at the top plate 14 and the bottom plate 16. Each of the walls 48 is sealed to the sidewall structure 17, for example, to either sidewall 50 or sidewall 52 and extends towards the other sidewall for most of the width of the chamber. Each wall 48 terminates prior to reaching the opposing wall to provide a single connected discharge path as illustrated in FIG. 2. Generally, the length of the discharge path 46 is a principal factor in determining the light output and the luminous efficiency of a lamp, the longer the discharge path, the greater the light output and efficiency according to Pascend's law. The serpentine discharge path 46 provides a longer discharge path between electrodes 34 and 36, further increasing the efficiency of the lamp. In addition, the discharge chamber 46 is constructed out of round, either rectangular or square. Improved efficiency of operation and greater output per wattage is generally achievable when the discharge is constructed out of round. The lamp 10 may be in the range of 0.2–>12 inches across and in the range of 0.2–0.75 inch in thickness. The serpentine walls 48 also permit a larger, thin lamp because they provide support to plates 14 and 16 so they can be thinner without danger of implosion.

In the embodiment of FIGS. 2–4, cathodes 34 and 36 are combined cathodes of hot cathode and cold cathode. Electrode 34 includes a hot cathode 54 and a cold cathode 56. Similarly, electrode 36 includes a hot cathode 58 and a cold cathode 60. Planar electrodes 22, 24 are capacitive coupling electrodes. Conductors 90–96 permit coupling the electrodes to an outside power supply. As shown in FIG. 4, electrodes 92 and 93 are coupled to the cold cathodes 56 and 60. Electrodes 94 and 96 are coupled to the hot cathodes 54 and 58. Electrodes 90 and 91 are coupled to the planar electrodes 22 and 24, respectively. The vertical cold cathodes 56 and 60 preferably have vertical, opposing metal strips and are open on the top and bottom to permit light to be emitted, as shown in FIGS. 2–4.

DC power supply 74 provides the heating power for the hot cathodes 54. DC to AC inverter 51, 53, and 55 (sometimes called an electronic ballast) convert DC voltage from a DC power supply (not shown) to the desired AC frequency, generally one inverter for each pair of electrodes. For example, an inverter 51 converts the power for the hot cathodes 54 and 58, an invertor 53 converts the power for the cold cathodes 56 and 60, and an inverter 55 converts the power for the planar electrodes 22 and 24. In one embodiment, the same invertor is used for each electrode pair and the phases are offset by other circuitry. Alternatively, a separate and direct AC power supply is provided for each electrode pair or DC power supply 74 is used for the power. As will be appreciated, the power supplies to the electrodes can be configured a variety of suitable ways to provide the power.

A discussion of the cathode-fall zone as altered by either a hot cathode or a cold cathode may be useful. Current flows at the transitional region just in front of a cathode producing a cathode-fall, or voltage drop, which pulls electrons away from the cathode. The work function of the cathode material at the temperature of the cathode as well as the ionization characteristics of the current carrying gas determine the magnitude of the cathode-fall. As cathode-fall increases, a greater number of heavy mercury ions impact into the cathodes, slowly sputtering the cathode away and turning energy into heat. The cathode-fall causes a power loss in the region immediately adjacent the cathode. In a fluorescent discharge chamber this results in a small dark region adjacent the cathode.

Hot cathodes are filaments which glow, similar to the glow given off by incandescent globes, but not as bright. The hot cathodes utilize a thermionic emission in which the electrons are essentially boiled into the arc stream from the hot coiled filaments which must have a temperature in the range of 1000° C. Electrons stream from a hot spot on the filament, which results in a total cathode-fall of only 12–15 volts. A brightness of several thousand footlamberts is achievable. The hot cathode lamp can thus be brighter than a cold cathode lamp. In addition, the cathode-fall region is generally very short so that the dark space near the end of a lamp is correspondingly short and the light is more uniform through the discharge chamber.

A hot spot on the hot cathode must be held in the temperature range of approximately 1000° C. for the cathode to remain a hot cathode. When the hot spot on the filament of the cathode can reach an operating temperature from the temperature given off by the arc current of the plasma heating alone, supplemental heating of the hot cathode is not required. However, at lower lamp temperatures, the hot spot may become too cold and as the hot cathode begins to operate in a cold cathode manner; however, the material and structure of the hot cathode is unsuited for cold cathode operation. Therefore, when the arc current does not supply sufficient heat to the hot spot for proper hot cathode operation, it is necessary to supply supplementary heating to the filament, such as by resistive heating from DC power supply 74.

A hot cathode is generally more efficient because the power lost at the cathode is minimized. The most efficient operation is provided when supplemental heating is not required to maintain the cathode at the desired operating temperature. A hot cathode also has the advantage of a higher light output for a given amount of power.

Cold cathodes do not use a high temperature typically coated with an emissive coating. From the cold cathode., electrons enter the plasma by field emission, also called secondary electron emission. The temperature of the cold cathode is generally in the range of 150° C. and there is a cathode-fall of usually greater than 80 volts. Cold cathodes generally have a lower ultimate brightness than hot cathodes, usually less than a thousand footlamberts in miniature fluorescent tubes.

At very low currents, the cold cathode is more efficient than the hot cathode because the filament of the hot cathode requires supplementary heating to maintain incandescence at the filament when at low currents. Cold cathodes .can thus easily be dimmed down without complicated drive circuitry. The large area of the cold cathode also, gives longer life because, with low current flow, few cathode electrons are required to sustain the arc and the electrons of the large cathode are not depleted so quickly. The disadvantage of the cold cathode is that the higher cathode-fall voltage, usually greater than 80 volts and sometimes as high as 200 volts results in greater losses and less efficiency.

Use of the hot cathode has the advantage of providing a much brighter light for a given lamp. If an extremely high light output is desired, a hotter cathode may be used. For high temperature operation, all surfaces including the upper plate are constructed of a high temperature ceramic or hard glass. The sidewall structure 17, interior walls 48, and lower plate 16 may all be an opaque, IR-absorbing ceramic.

The actual wattage expended at the electrodes is a product of the voltage drop at the electrodes times the plasma arc current. Because of the high voltage drop of the cold cathode and the lesser equivalent voltage drop for a hot cathode, there is greater wattage dissipation, consequently, more heat generated at the terminals of cold cathode lamp than at the terminals of a hot cathode lamp. Because of the wattage loss at the electrodes, a hot cathode lamp will always be more efficient in overall lumens per watt, because the expenditure of watts into the arc stream for both the hot and a cold cathode will be the same. For the reasons explained above, hot cathodes have generally found use as backlights for LCD screens despite their efficiencies because of the numerous drawbacks.

For more detailed information on hot and cold cathodes, see "Fluorescent Backlights For LCDs," by Mercer and Schake, *Information Display*. pp. 8–13, November 1989.

In the embodiment of FIGS. 2–4, the cold and hot cathodes can be operated simultaneously. Alternatively, the cold cathodes may operate alone when low light levels are desired; the hot cathode may operate alone. As a further alternative, and usually preferred, the hot and cold cathodes will operate simultaneously with the planar electrodes 22 and 24.

Figure 5:
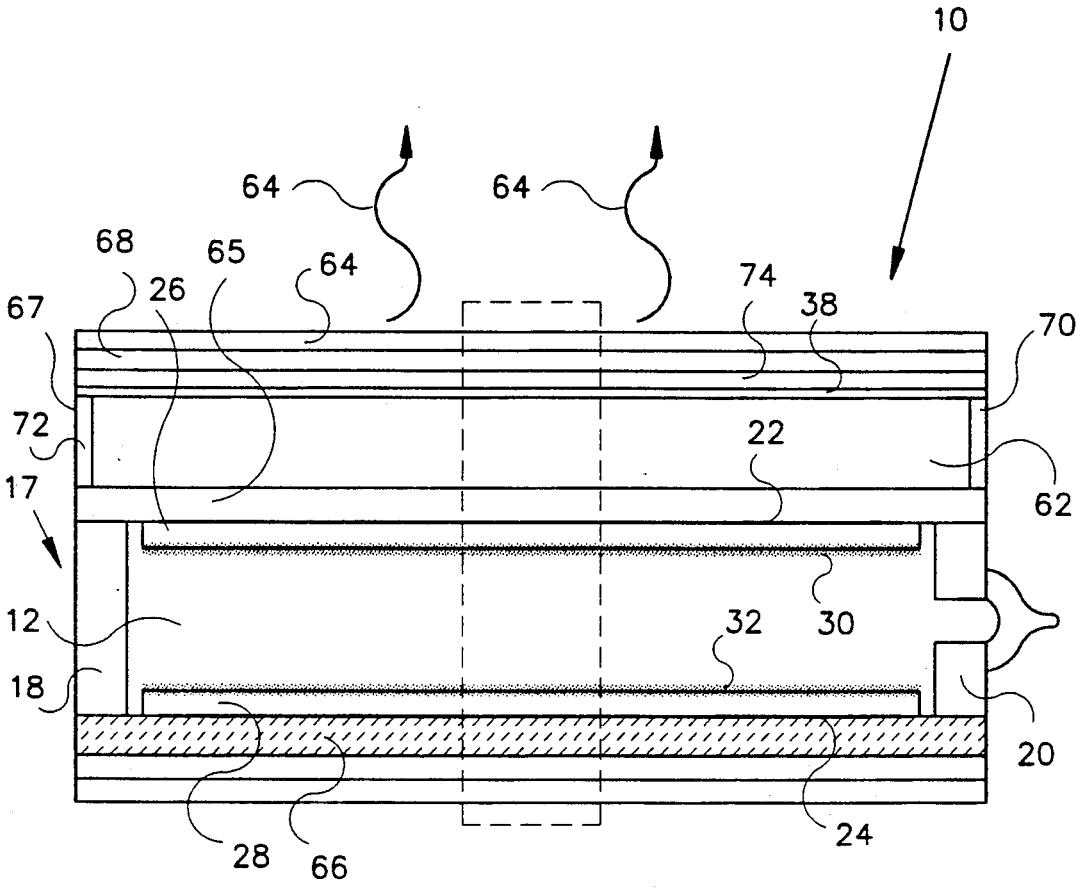
FIG. 5 is a side cross-sectional view of an alternative embodiment of the invention having two chambers and ground electrodes.
Figure 6:
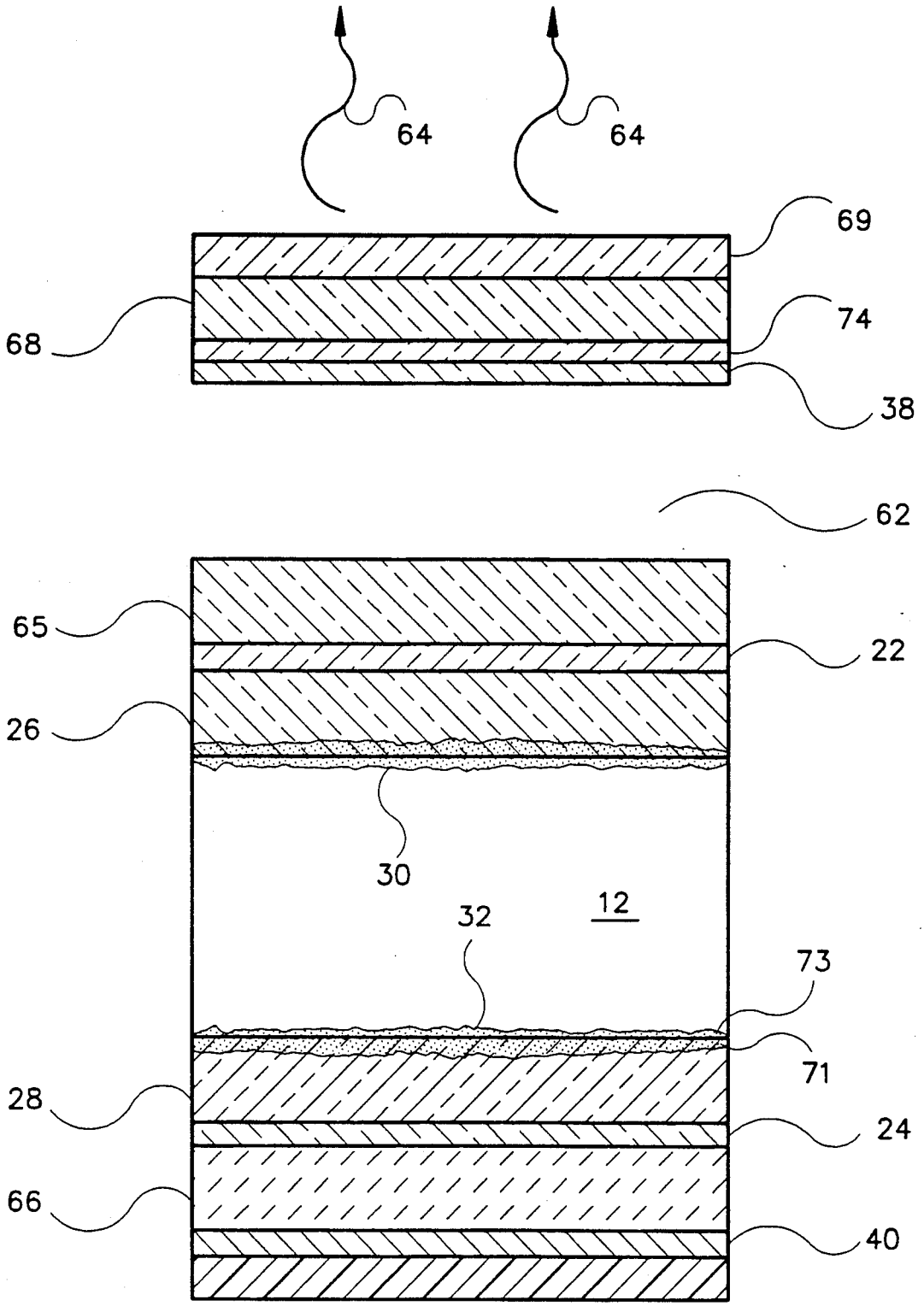
FIG. 6 is an enlarged view of a region of the cross-sectional view of FIG. 5.

An alternative embodiment is shown in FIGS. 5 and 6, in which the lamp 10 includes a primary chamber 12 and a secondary chamber 62. Light 64 is emitted only out of the top of lamp 10. (The details of the electrodes are not shown for simplicity in illustration. The electrodes and drive circuitry could be any combination of those in the prior art or those previously discussed with respect to other embodiments of this invention.)

The primary chamber 12 is defined by an upper plate 65, a lower plate 66, and sidewall structure 17 having sidewalls 18 and 20. The primary chamber. 12 contains an inert gas and mercury vapor at a selected pressure as described with respect to FIG. 1. Planar, horizontal electrodes 22 and 24 overlay the respective plates 65 and 66. Lead-free glass layers 26 and 28, respectively, overlays each of the horizontal electrodes 22 and 24. The lead-free glass layers 26 and 28 are dielectrics which insulate the respective electrodes 22 and 24 from the interior of the chamber 12. A soda lime glass, or other lead-free glass, is acceptable for use as the dielectric layer 28. Overlaying each of the glass layers 26 and 28 are respective phosphor layers 30 and 32.

The lower plate 66 is constructed of a black ceramic glass which acts as an infrared heat absorber to draw heat away from the front of the lamp and towards the back. As an alternative to using a black glass for the lower plate 66, a black ceramic film coating may be applied which provides the same function of absorbing heat in the form of infrared light. A titanium-doped ceramic film may be applied on top of the plate 66 to reflect ultraviolet light back into the phosphor film 32, increasing the lamp's overall efficacy. The U.V. reflective film could also be composed of other materials, such as ZnO, $Al_2O_3$, Zirconia, or the like. A grounding shield of electrodes 38 and 40 can be provided if desired. A dielectric layer 39 is provided below the grounding electrode 40 to isolate it from the surrounding environment.

The upper plate 65 of chamber 12 is an implosion resistance plate that is transparent to white light. Light emitted by the phosphor layers 30 and 3 shines out of the chamber 12 by passing through the transparent plate 65.

The secondary chamber 6 is defined by planar face plate 68, upper plate 65 (the upper plate 65 is actually the lower plate of the secondary chamber 62) and sidewalls 70 and 72. In the embodiment of FIGS. 5 and 6, the upper chamber 62 is at atmospheric pressure and is open to the air. Cooling air, or alternatively, cooling fluid, flows through the secondary chamber 62 to cool the lamp as needed. Overlying face plate 68 is a diffuser coating 74 and a grounding electrode 38 on the inside surface of the secondary chamber 62. Overlying the top surface of the face plate 68 is a dichroic mirror 69. The dichroic mirror is constructed from a dichroic film of a known material that is transparent to white light but reflects heat, such as infrared radiation, back into the lamp.

As illustrated in the simplified view of FIG. 5, the lamp 10, in one embodiment, includes a plurality of chambers. (FIG. 5 shows features of a two-chamber lamp and does not show other features present in the lamp for similarity of illustration.) A secondary chamber 62 is formed on top of primary chamber 12. The primary chamber 12 is generally the chamber at the lowest pressure and usually includes the mercury vapor which emits high amounts of ultraviolet light. The secondary chamber 62 includes a planar face plate 68 and a sidewall structure 67. The top plate 14 of the primary chamber 12 forms the bottom plate of the secondary chamber 62. The secondary chamber has many uses and configurations, examples of which will now be described.

The secondary chamber 62 permits thinner plates to be used in the lamp 10 without danger of imploding. It is known that mercury vapor should be held in the pressure range of 3–8 microns for a maximum light output or overall efficiency. In addition, the chamber 12 must be evacuated of air and refilled with a very low-pressure inert gas, such as argon, to a selected pressure. If the gas pressure within the chamber 12 becomes too low, the lamp will implode, with the planar plates 14 and 16 collapsing into the chamber 12, destroying the lamp 10. In the past, this danger of imploding has been guarded against by making the plates 14 and 16 sufficiently thick to withstand the pressure difference between the low pressure inside of the chamber 12 and atmospheric pressure. The thicker plates to prevent implosion have the disadvantage of causing greater light losses because the visible light emitted by the phosphors must travel through the planar plates from the inside of the chamber 12.

According to one embodiment, the pressure in the secondary chamber 62 is at an intermediate pressure, between atmospheric pressure and the low pressure of the chamber 12. This places less stress on the planar plate 14 between the two chambers. The planar plate 14 may therefore be made significantly thinner without danger of implosion. The lower planar plate 16 can remain as thick as desired because the light is emitted through the upper planar plate 14. The face plate 68 is the thickness required to prevent implosion caused by the pressure difference between secondary chamber 62 and atmospheric pressure. The face plate 68 can therefore be quite thin because the pressure in chamber 62 may be only slightly less than atmospheric pressure and will generally be higher than the pressure in chamber 12.

In alternative embodiments, the secondary chamber 62 is open to the ambient air. In this embodiment, the secondary chamber 62 may permit ambient cooling or forced air cooling. Alternatively, the secondary chamber 62 is filled at selected locations with thermal fluids which vaporize to locally cool the primary chamber 12 at selected locations from maintaining at least some portion of the mercury vapor pressure in the temperature range of 40° C.–50° C. while permitting the hot cathodes to achieve temperatures in the range of 1000° C. A cooling fluid may be forcibly circulated within the second chamber to maintain the lamp below a selected temperature. Alternatively, the secondary chamber 62 forms a thermal vacuum to block heat from being emitted out of the front of the lamp 10 The secondary chamber may also be a light diffuser, providing uniform light out of the lamp from a nonuniform light source in chamber 12. The ultimate use of the secondary chamber is dependent upon the specific application.

As will be appreciated, features in FIGS. 5 and 6 are not to scale. For example, the conductive films that form electrodes 22 and 24 are in the range of less than a micron in thickness while the glass plate 66 is in the range of ⅛ of an inch in thickness. The phosphor crystals .have an average diameter in the range of 3–4 microns and the dielectric layer 28 has a thickness sufficient to provide a pin hole free surface, usually greater than 5 microns and likely in the range of 10–30 microns.

Figure 7:
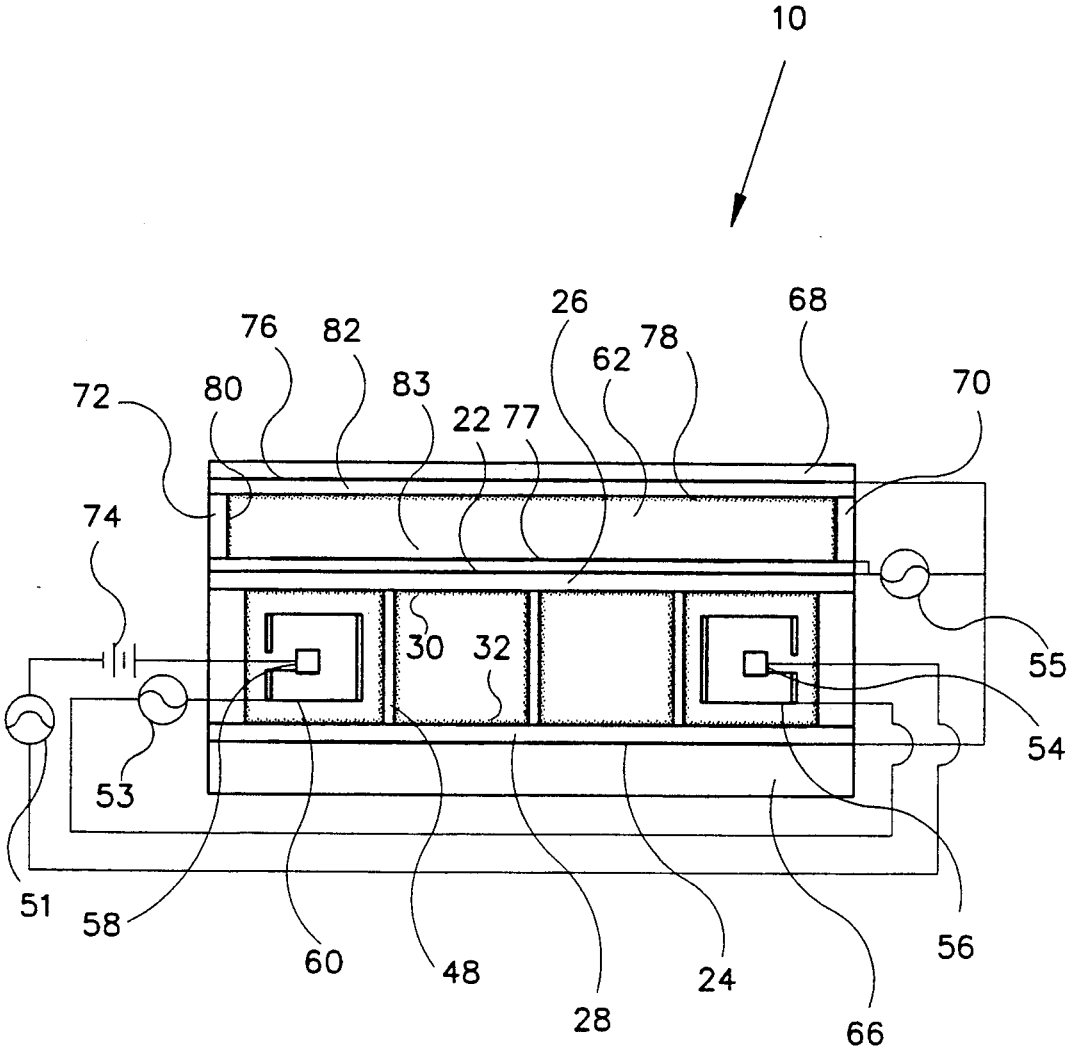
FIG. 7 is a cross-sectional view of an alternative embodiment of a serpentine, multi-chamber lamp.
Figure 8:
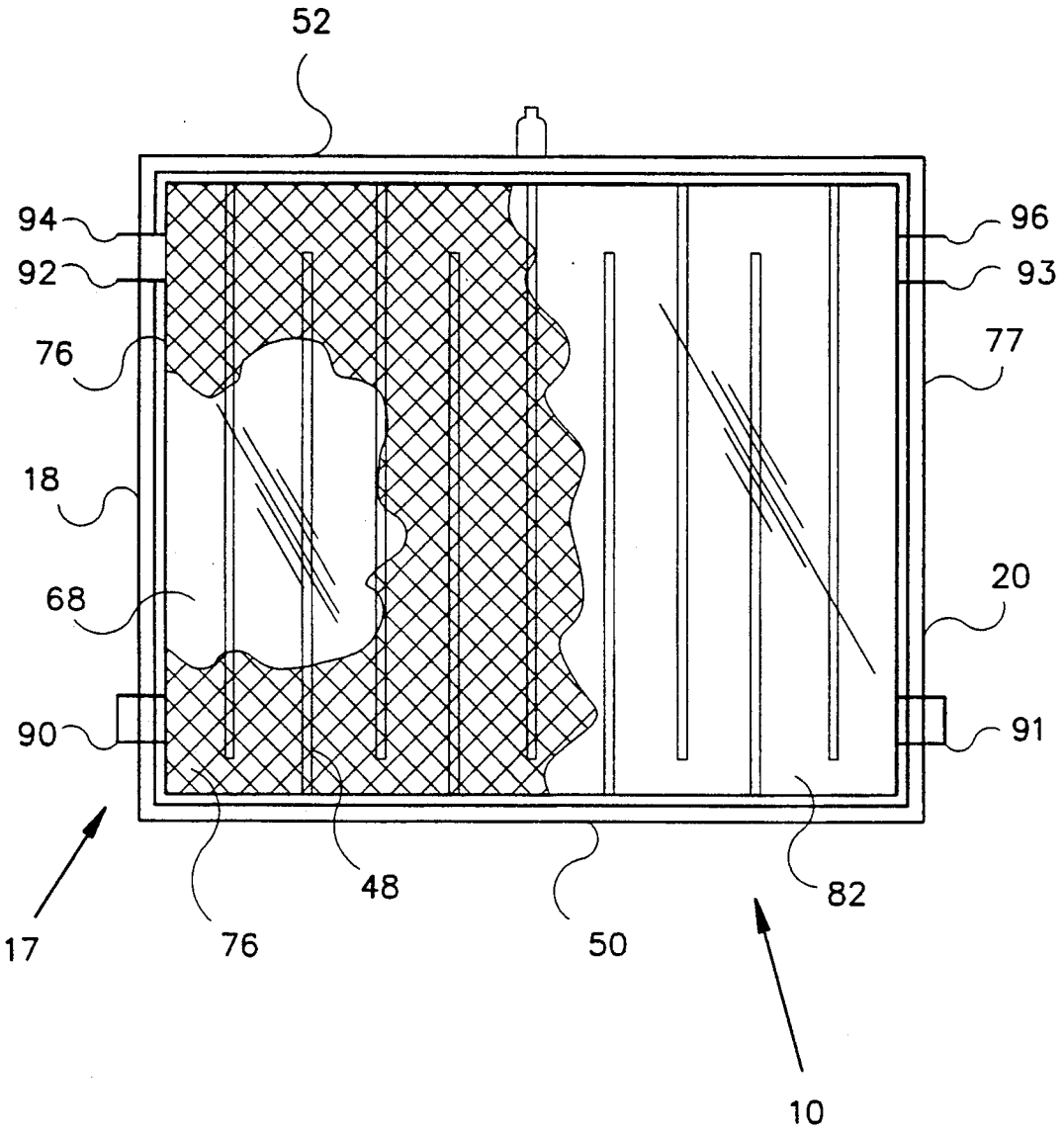
FIG. 8 is a top plan view of the lamp of FIG. 7.

FIGS. 5–8 illustrate examples of multiple chamber lamps for specific applications. FIGS. 5 and 6 show a double chamber lamp for use in avionics, such as the backlighting of an aircraft display panel. FIGS. 7 and 8 are miniaturized, serpentine primary chamber overlaid by a light-emitting secondary chamber for use in LCD displays where dimming is desired, or other uses. The phosphor layers 30 and 32 are specially formed to provide improved performance. An example of the formation of phosphor layer 32 on dielectric layer 28 will now be described in detail for illustrative purposes.

The phosphor 32 is applied to the glass layer 28 while both are cool, prior to the lamp 10 being assembled. The phosphor layer 32 is applied by any acceptable technique, including screen printing, thick film printing, spraying, dipping, brushing, or other acceptable techniques. The phosphor 32 is usually mixed into a slurry prior to applying it to the glass layer 28, the techniques of making a phosphor slurry being well known in the art. The glass used for the dielectric layer 28 has a selected reflow temperature, that is, the temperature at which the glass becomes sticky and begins to melt. Preferably, the glass reflow temperature is approximately 600° C.

The glass layer 28 is then heated to approximately its reflow temperature, with the phosphor layer on top of it. At the reflow temperature, the glass becomes quite sticky and begins to melt slightly at the surface. A reflow temperature below the temperature at which phosphor degrades is selected. The dielectric layers should have the proper thickness to create a uniform elective field within the chamber 12. For most glass materials, a thickness greater than 5 microns is used to ensure a uniform covering without pin holes in the dielectric layer. Preferably, the thickness is less than 25 microns to provide good light transmission properties. Thus a dielectric layer for 26 and 28 in the range of 5–25 microns is acceptable; though other thicknesses may be used in some environments. For those, phosphors that degrade at or below 700° C., the reflow temperature of the glass 28 is selected to be below this temperature, preferably in the range of 600° C.–650° C. A soft glass which is free of heavy metals is selected so that the phosphor will not be degraded in the glass. A non-vitrifying glass having the proper reflow temperature is acceptable.

Hard glass is generally more transparent to U.V. light than soft glass and is usually preferred for upper plate 65 and face plate 68. In some environments, a hard glass for the dielectric glass layers 26 and 28 could be used. For example, an alumina-silicate, boro-silicate, quartz, pyrex, or the like, which are considered hard glasses and generally having a reflow temperature of 650° C., could be used for dielectric layers 26 and 28. Hard glass generally has a higher reflow temperature than soft glass, and a glass having an even higher reflow temperature, in the range of 700° C.–1000° C., could be used; but if such a choice is made, preferably phosphors are selected which will not significantly degrade when heated to the reflow temperature of glass selected for dielectric layer 28. If hard glass is used for the dielectric layers, the upper and lower plates are also a hard glass to ensure that they have a similar coefficient of thermal expansion. Preferrably, the reflow temperature of the dielectric layer of glass is not higher than the reflow temperature of the plates, to ensure that the plates do not melt when the temperature is raised to embed the phosphors in the dielectric layer.

As the glass layer 28 becomes somewhat sticky at the surface region, the phosphor layer becomes embedded into the glass at a very slight depth. The glass 28 is not heated to its liquid state melting point; it is only heated sufficiently that the surface becomes sticky and the surface region melts slightly. The glass layer and 28 with the phosphor on its surface is then cooled to trap the phosphor crystals embedded within the glass layer. The rate and manner of cooling is not particularly critical and can be carried out naturally by letting the glass cool toward rom temperature by turning off the kiln and venting it to ambient air to permit it to cool over time. A cooling rate in the range of 1° C.–25° C. per has been found acceptable. During mass production, forced cooling using circulating fluid, such as air, may be necessary if a large mass of glass plates are together; however, cooling techniques of glass in the construction of fluorescent lamps is generally known in the art and any suitable technique which maintains the integrity of the glass to keep it free of cracks is acceptable.

After the glass 28 cools, the loose phosphor is wiped off the glass. The phosphor layer 32 which remains is adhered to the glass or to phosphor crystals that adhere to the glass. The phosphor layer 32 is therefore quite thin, usually 3 to 5 layers of crystals. In one embodiment, only a very thin layer of phosphor is originally applied to the glass layer 28, and wiping off of excess phosphor is omitted because it is not required.

The phosphor layer 32 is shown with a portion of it extending into the glass layer 28, a portion of it at the surface, and a portion of it extending out of the glass layer 28. As the glass cools with the phosphor layer 32 thereon, some of the crystals will be completely embedded within the glass layer 28, some of the crystals will be partially embedded and completely surrounded by other crystals, other crystals will partially embedded and partially exposed to the atmosphere, while other crystals will be exposed to the atmosphere over a large surface area and partially surrounded by other crystals. The phosphor layer 32 is shown in stepped fashion to illustrate that some crystals 71 are embedded completely within the glass layer 28 and some crystals 73 are completely outside of the glass layer 28, on a surface region thereof. The embedded crystals 71 are in solid form, completely embedded within the glass layer 28 and are not exposed to the atmosphere within chamber 12. On the other hand, the crystals 72 are exposed to the atmosphere of the chamber 12.

Reference has been made to dielectric glass layer 28 and the phosphor layer 32 to illustrate one technique for applying the phosphor layer to glass. The dielectric layer 26, as well as any dielectric and phosphor layers of the various embodiments of the invention, can be similarly constructed if desired. For example, the lamp of FIGS. 1–3 which have only a single chamber can be constructed with an embedded/exposed phosphor, as described.

As can be appreciated, the phosphor layer 32 is embedded into the glass layer 28 so that it can be used in a lamp 10 of which embodiments are show in FIGS. 1–8. Prior to applying the phosphor layer 32 to the glass layer 28, the glass layer 28 is overlaid on an electrode 24 which is affixed to a planar plate 16, or alternatively an opaque plate 66. The plate 16 which forms a part of the chamber is a glass having a higher reflow temperature than the temperature of the glass layer 28. The plate 16 may be, for example, an alumina-silicate glass, a borasilicate glass or other hard glass having a comparable reflow temperature above 650° C. After the plate 16 has been prepared by applying the electrode 24 and the glass layer 28, the phosphor layer 32 is applied and the entire assembly is heated, and then cooled in the manner described. The glass plate does not melt because it has a higher reflow temperature than that of the glass layer 28.

After the upper plate 14 and lower plate 16 have been prepared as has been described, the plates are assembled into a completed lamp 10 similar to that shown in FIGS. 1–8. Assembling the lamp may be performed by positioning the glass plates and sidewall structures which will form the lamp adjacent to each other and bonding them together with an appropriate adhesive. Appropriate adhesives include glasses or ceramics having a selected reflow temperature to bond to each of the glasses, a U.V. epoxy resin, a silicon adhesive (such as the type used in aquariums), or other suitable adhesive for permanently bonding the glass structures of the lamp to each other.

In one embodiment, the phosphor layers are applied to the dielectric layers and the lamp is assembled prior to an additional heating step. During final assembly of the lamp, the entire lamp is heated to bond the members together, as may occur if a glass having a low reflow temperature is used in the bonding. During the heating up of the entire lamp during the bonding process, the glass layers 26 and 28 may also slightly melt, causing the phosphor to become partially embedded within the layers which they overlay.

Having the phosphor layer 32 crystalized within the glass layer 28 partially embedded and partially exposed provides significant advantages that enhance the emission of light and lamp brightness controllability, as will now be explained.

Having some of the crystals of the phosphor layer 32 embedded within the glass layer 28 increases the efficiency of the light transmission. Light generated by the phosphor layer 32 by the fluorescent phenomenon passes directly through the crystal structure of the phosphor layer 32 and into the glass layer 28 with high efficiencies. Additionally, light generated by phosphor crystals within the dielectric layer 28 by both the fluorescent and electroluminescent phenomenon passes directly from the crystal embedded in the glass into the glass itself with high transmission efficiencies. This is distinguished from the prior art in which the phosphor layer is merely dusted onto the glass and is not embedded within the glass itself. In the prior art, some of the light emitted by the phosphor is reflected by the phosphor/gas/glass interfaces, decreasing the transmission efficiency of light from the phosphor to the exterior of the lamp. The embedded phosphor layer decreases reflections of white light from the phosphor/glass interface.

The phosphor layer 32, formed as described, emits light under a vacuum fluorescence phenomenon and also under electroluminescence phenomenon. For background purposes, an explanation of the vacuum fluorescence phenomenon and the electroluminescence phenomenon may be useful.

The vacuum fluorescence phenomenon is the emission of visible light from ultraviolet light striking the phosphors, the ultraviolet light being provided by mercury vapors within the chamber 12. When power is applied to the electrodes of the discharge chamber 12, ultraviolet electromagnetic radiation at approximately 2537 angstroms is emitted. The ultraviolet electromagnetic radiation impinges on the phosphor coating 32 and excites the phosphor to cause it to emit. The visible light is then emitted by the lamp 10. Fluorescence is thus the excitation of visible light photons when ultraviolet light strikes the phosphor.

Electroluminescence, on the other hand, is a solid-state, electric field phenomenon. Some solid materials, such as a ceramic having a zinc sulfide powder embedded therein, has been shown to emit light when subjected to an intense alternating current electric field. The ceramic may be the dielectric of a capacitor, for example, electroluminescent lamp in which a ceramic layer 7 having particles of phosphor embedded therein is exposed to an electric field to cause the solid ceramic block to emit light is shown in U.S. Pat. No. 2,900,545. After finding that electroluminescent phosphors emit light according to the electroluminescent phenomenon, it became desirable to construct a structure that would simultaneously operate on electroluminescent and fluorescent phenomena.

The phosphor layer 32 preferably includes both fluorescent and electroluminescent phosphors. In one embodiment, zinc sulfide, a known electroluminescent phosphor, doped with a suitable element , such as copper, silver, manganese, chlorine, or the like, is used. Also mixed in the same phosphor slurry are fluorescent phosphors. Many fluorescent phosphors are known and, preferably, a mixture of three triband rare earth phosphors, one red, one green and one blue, are mixed in the slurry. The selected phosphors are combined in various proportions to give the desired spectral and brightness output. (Fluorescent phosphors are known in the art; a person of ordinary skill would select the particular rare earth phosphors and spectral proportions desired for each application following well-known techniques published in the literature, see, for example, previously cited article by Mercer, or Waymouth, John F., "Electric Discharge Lamps," MIT Press, IBSN 0262-23058-8.)

In one embodiment, the phosphor slurry includes 90% fluorescent phosphors by weight and 10% electroluminescent phosphors by weight. For example, the slurry may include 10% zinc sulfide by weight and 90% rare earth phosphors. Other proportions, such as 20% and 80%, 45% and 55%, or 55% and 45% can be used.

If desired, an additional thin film of magnesium oxide may be overlaid directly on top of the ceramic dielectric film approximately to a thickness in the range of 250 angstroms to 5 microns prior to applying the phosphor layer 32. As is known in the art, the additional layer of magnesium oxide will lower the on/off threshold for light emission by the phosphor. Other materials which alter the on/off threshold for secondary emission can be used, if desired, such as $Y_2O_3$, $Al_2O_3$, $TiO_2$, $ZnO_2$, $BN_6$, $SiO_2$, or $BaTiO_2$, etc.

In the embodiment of FIGS. 5 and 6, the lamp 10 simultaneously outputs fluorescent light and electroluminescent light. The light from both phenomena is combined as the light output.

The fluorescent phenomenon is created by vertical cathodes 34 and 36 creating a plasma arc, or positive column within the fluorescent chamber 12 to convert the electrical energy into ultraviolet radiation that the phosphor layer 32 converts into visible light. Planar elect-odes 22 and 24 also aid in creating a more uniform plasma arc within the atmosphere of the chamber 12 to provide uniform, bright light based on the fluorescent phenomenon. The horizontal electrodes 22 and 24 also impose an electric field on the solid dielectric layer 28 which includes phosphor crystals from phosphor layer 32 embedded therein. The solid dielectric material emits visible light directly, based on the electroluminescence phenomenon when exposed to this electric field. The internal cathodes 34 and 36 and the horizontal electrodes 22 and 24 tend to be individually controlled to selectively control the percentage of light output based on the fluorescent phenomenon or the electroluminescent phenomenon. Generally, the light emitted will be a combination of fluorescent light and electroluminescent light, both phenomena operating simultaneously within the single lamp.

Electroluminescent materials have the advantage of emitting uniform light while operating at relatively low temperatures. However, electroluminescent lamps generally have a low ultimate brightness, about lumen per watt. The low brightness of electroluminescent is generally considered a disadvantage. However, in the present invention, a lamp having the low-level light output of electroluminescence is advantageously used in combination with the high-level light output of fluorescent lamps to provide a useful lamp. In some environments, it is desirable to vary the light out of the lamp over a wide range. As previously explained, while hot cathodes emit great amounts of light and are very efficient at full power, it is extremely difficult to dim a fluorescent lamp having hot cathodes because the cathodes do not maintain the required operating temperature.

According to principles of the present invention, a hot cathode fluorescent phenomenon is used in conjunction with the cold cathode and the electroluminescent phenomenon from the phosphors. When it is desirable to dim the lamp, the hot cathodes may be shut off completely, so that they draw no power; the desired level of dim light is provided by the combined cold cathode and electroluminescent phenomenon of the very same lamp. For even more low light control, the cold cathodes are turned off and only the planar electrodes 22 and 24 remain on. The planar electrodes create uniform electroluminescent light of low brightness, as may be desired in some applications. The planar electrodes can also create fluorescent light by capacitive coupling, depending on the applied voltage. The voltage is adjustable to provide the desired light output. The low-light level illumination range and adjustability of the lamp is therefore significantly increased using the combined fluorescent and electroluminescent phenomenon.

FIGS. 7 and 8 illustrate a lamp 10 having a sealed secondary chamber 62. As previously described with respect to the other figures, the lamp 10 of FIG. 7 includes a primary chamber 12 having serpentine walls 48 therein. The serpentine walls support the upper plate 65, permitting it to be made somewhat thinner than would otherwise be possible without the intermediate walls. The vertical cathodes 34 and 3 include respective hot cathodes 58 and 54 and cold cathodes 56 and 60 as have been previously described. A power supply 55 provides power to planar electrodes 22, 24, 76, and 77. Electrodes 24 and 76 are coupled to one side of power supply 55 and electrodes 22 and 77 are coupled to the other side. Power supplies 51 and 53 provide power to internal cathodes 34 and 36. DC power supply 74 provides additional power to heat the hot cathodes 58 and 54 as necessary.

The inner surfaces of upper chamber 62 includes phosphor layer 78 on the upper surface. In one embodiment, a pair of planar electrodes 76 and 77 are overlaid by respective dielectric layers 82 and 83 and an electric field is applied on the secondary chamber 62. The second pair of planar electrodes 76 and 77 is powered from the same power supply 55 as the first pair of planar electrodes 22 and 24. Alternatively, a separate power supply is provided for each pair of planar electrodes.

The interior of secondary chamber 62 is filled with the appropriate atmosphere, such as an inert gas, at a suitable pressure. The secondary chamber 62 does not include mercury vapor in one embodiment, but does include mercury vapor in an alternative embodiment. Similarly, in one embodiment, there are no internal cathodes within the secondary chamber 62. However, in an alternative embodiment, vertical and planar electrodes are both provided.

The pressure of secondary chamber 62 is intermediate between atmospheric pressure and the very low pressure of the primary chamber 12. A pressure in the range of 8–25 mm of mercury is acceptable for the secondary chamber 62, the primary chamber 12 being in the range of 2–6 mm of mercury. A relatively thick, implosion-resistant lower plate 66 prevents implosion due to the difference between atmospheric pressure surrounding the plate 66 and the low interior pressure of the primary chamber 12. On the other hand, the upper plate 65 is a significantly thinner plate and is not necessarily sufficiently strong by itself to prevent implosion based on the pressure difference between atmospheric pressure and the low pressure of primary chamber 12. However, the upper plate 65 is not subjected to atmospheric pressure. Rather, it is only subjected to the pressure difference between the secondary chambers 62 and the primary chamber 12. The upper plate 65 can therefore be made extremely thin and thus more transparent to white visible light and ultraviolet light. Some ultraviolet light passes from primary chamber 12 completely through upper plate 65 and into secondary chamber 62. This ultraviolet light impinges upon phosphor layer 78 within the upper chamber 62, causing this upper layer 78 to emit fluorescent light. Therefore, even if electrodes 76 and 77 are not present, the phosphor layer 78 emits light based on the ultraviolet radiation escaping from primary chamber 12. This secondary source of white light emissions provides more uniform, brighter light because a greater percentage of the ultraviolet radiation is being used.

In an alternative embodiment, power is supplied to upper planar electrodes 76 and 77, creating a plasma arc within the upper chamber 62 for local generation of ultraviolet radiation that impinges upon phosphor layer 78, causing it to emit white light. The secondary chamber 62 may include more phosphors and may operate at a different pressure, generally a significantly higher pressure than the primary chamber 12. This permits thinner, larger area glass plates to be used for top faceplate 68 and upper plate 65 without the danger of implosion. In this embodiment, the secondary chamber 62 emits light based on the electroluminescent phenomenon locally generated and the fluorescent phenomenon caused by ultraviolet light escaping from primary chamber 12

Figure 9:
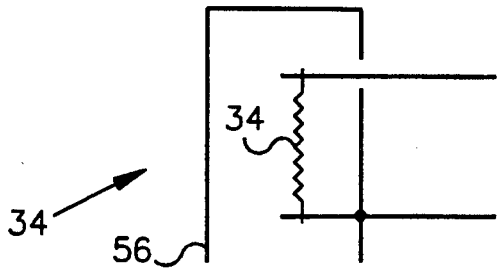
FIG. 9 is a top plan view of a combined hot and cold cathode.
Figure 10:
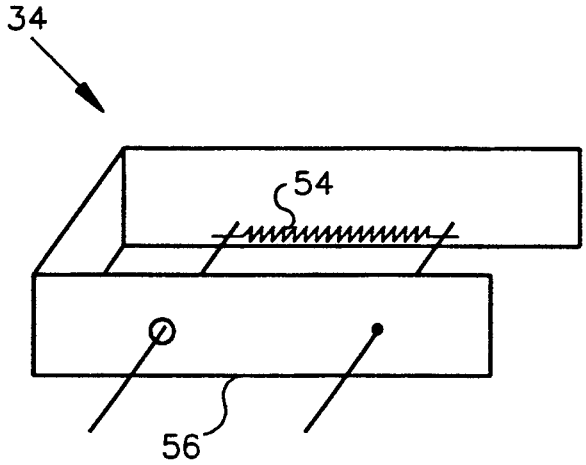
FIG. 10 is an isometric view of the combined cathode of FIG. 9.
Figure 11:
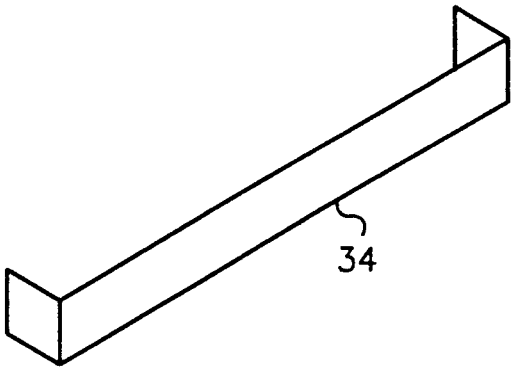
FIG. 11 is an isometric view of an alternative embodiment of a cold cathode.

FIGS. 9–11 illustrate possible shapes for internal cold cathodes 56 and 60. In the embodiment of FIGS. 2–8, the cold cathodes 56 and 60 are formed of flat conductive strips bent at two locations. The metal strips are open on the top and bottom so they do not block light that may be emitted out of the top or bottom. Preferably, the two sides of the cold cathode are adjacent the wall 20 and internal 48, and the back is adjacent the wall 52, as shown in FIG. 2. The AC power supply is electrically connected to both the cold cathode and the hot cathode in one embodiment, as shown in FIGS. 9 and 10. The DC power supply is coupled only to the hot cathode to provide supplemental heating as necessary.

As shown in FIG. 11, the cold cathode may be a generally flat, thin strip for use in the open chamber lamp of FIG. 1. The strip is flat so as to not block U.V. from striking the phosphors at the edges of the lamp or white light that may be emitted. The ends may be bent and extend for a short distance along either side of the lamp, though this is not required and in one embodiment, the cathode is a planar, flat metal strip for its entire length. Using a planar strip for the cathodes permits the light to be uniformly bright across the entire face of the lamp, even to the very edges. The lamps can then be placed edge-to-edge to form an array of many lamps to cover a large area and emit light uniformly, even though many lamps are used.

The cathodes of FIGS. 9–11 can be fixed directly to the walls they are adjacent, if desired, but preferably are spaced from the walls by a small distance, in the range of 10–1000 microns.

The invention has been described and illustrated with respect to various alternative embodiments. It will be understood by those of ordinary skill in the art that numerous inventive features described in one embodiment may be used in combination with inventive features described in other embodiments. Various embodiments of lamp 10 have been described. Specific features are illustrated in the various embodiments. The features of one embodiment can be combined with the features of other embodiments if desired. For example, phosphor layers formed by standard prior art techniques as shown in FIG. 1 can be used for the layers in the lamps of FIGS. 2–8 rather than the embedded layers. Similarly, the single open chamber configuration of FIG. 1 could have walls 48 therein to form a serpentine chamber. Alternatively, the lamps of FIGS. 2–8 could be all open area chambers. The planar electrodes of FIG. 1 are not required in the two-chamber embodiments of FIGS. 5–8, such lamps being operable with only internal cathodes in the chamber itself if desired. All other features of the various embodiments could also be combined, as desired, without using all the features in one lamp and such lamp would still fall within the scope of this invention. Additionally, equivalent structure may be substituted for the structure described herein to perform the same function in substantially the same way and fall within the scope of the present invention, the invention being described the claims appended hereto and not restricted to the embodiments shown herein.

I claim:

1. A lamp that emits light based on the fluorescent phenomena and the electroluminescence phenomena simultaneously, comprising:

a sealed chamber having a gas at a selected pressure therein and being formed with at least one light transparent member, said gas including mercury vapor for emitting ultraviolet light when subjected to an electrical field;

a pair of electrodes associated with said sealed chamber and positioned to apply an electric field to said gas within said sealed chamber a fluorescent phosphor adjacent said light transparent member within said chamber and positioned to be exposed to ultraviolet radiation emitted by said gas when an electrical field is applied by said electrodes; and an electroluminescent phosphor at least partially embedded within said light transparent member, said electroluminescent phosphor emitting visible light when an electric field is applied by said electrodes.

2. The apparatus according to claim 1 wherein said fluorescent phosphor is attached to an inside surface of said light transparent member.

3. A planar lamp having at least one transparent electrode, comprising:

a pair of facing, planar plates forming a top and bottom wall of a chamber, each of said plates having an inner surface facing an inside of said chamber;

a sidewall structure coupled to said plates and retaining said plates a fixed distance from each other, said plates and said sidewall structure together forming an enclosed chamber;

a gas of a selected composition and at a selected pressure within said chamber;

a pair of planar electrodes coupled to said planar plates and positioned to create an electric field within said chamber, at least one of said electrodes being transparent to light, a thin dielectric layer coupled to at least one inside surface of said plates and completely covering the electrode coupled to that plate, said thin dielectric layer being transparent to light; and a fluorescent material on an inside surface of said dielectric layer and exposed to said gas within said chamber so that when an electric voltage is applied to said electrodes, light is emitted from said lamp according to a fluorescent phenomena;

a second pair of electrodes extending into said chamber and surrounded by the gas within said chamber for creating a plasma arc within the chamber;

a first electric power source coupled to the pair of electrodes to selectively apply an electric voltage to said pair of planar electrodes for powering said lamp, said first electric power source being an alternating current power source at the a selected frequency; and a second electric power source coupled to the second pair of electrodes to selectively apply an electric voltage to said second pair of electrodes for providing a current path through the gas within said chamber from one electrode in said second pair to the other electrode in said second pair, said second power source being an alternating current power source at the same frequency as the selected frequency but driven out of phase from the first power source.

4. The planar lamp according to claim 3 wherein said planar electrodes have a surface area approximately equal to the inside surface area of said planar plates.

5. A planar lamp having at least one transparent electrode, comprising:

a pair of facing, planar plates forming a top and bottom wall of a chamber, each of said plates having an inner surface facing an inside of said chamber;

a sidewall structure coupled to said plates and retaining said plates a fixed distance from each other, said plates and said sidewall structure together forming an enclosed chamber;

a gas of a selected composition and at a selected pressure within said chamber;

a pair of planar electrodes coupled to said planar plates and positioned to create an electric field within said chamber, at least one of said electrodes being transparent to light, a thin dielectric layer coupled to at least one inside surface of said plates and completely covering the electrode coupled to that plate, said thin dielectric layer being transparent to light; and a fluorescent material on an inside surface of said dielectric layer and exposed to said gas within said chamber so that when an electric voltage is applied to said electrodes, light is emitted from said lamp according to a fluorescent phenomena;

a second pair of electrodes extending into said chamber and surrounded by the gas within said chamber for creating a plasma arc within the chamber;

a first electric power source coupled to the pair of electrodes to selectively apply an electric voltage to said pair of planar electrodes for powering said lamp, the first power source being an alternating current power source at a selected frequency; and a second electric power source coupled to the second pair of electrodes to selectively apply an electric voltage to said second pair of electrodes for providing a current path through the gas within said chamber from one electrode in said second pair to the other electrode in said second pair, said second power source being an alternating current power source at a different frequency than said selected frequency of said first power source.

6. The planar lamp according to claim 5 wherein said planar electrodes have a surface area approximately equal to the inside surface area of said planar plates.

7. A planar lamp having at least one transparent electrode, comprising:

a pair of facing, planar plates forming a top and bottom wall of a chamber, each of said plates having an inner surface facing an inside of said chamber;

a sidewall structure coupled to said plates and retaining said plates a fixed distance from each other, said plates and said sidewall structure together forming an enclosed chamber;

a gas of a selected composition and at a selected pressure within said chamber;

a pair of planar electrodes coupled to said planar plates and positioned to create an electric field within said chamber, at least one of said electrodes being transparent to light, said electrodes having a surface area approximately equal to the inside surface area of said planar plates;

a thin dielectric layer coupled to at least one inside surface of said plates and completely covering the electrode coupled to that plate, said thin dielectric layer being transparent to light; and a fluorescent material on an inside surface of said dielectric layer and exposed to said gas within said chamber so that when an electric voltage is applied to said electrodes, light is emitted from said lamp according to a fluorescent phenomena; and an electroluminescent material fixed to said dielectric layer within said chamber, said electroluminescent material emitting light when a voltage is applied to the pair of planar of electrodes, giving off light according to an electroluminescent phenomena simultaneously with the fluorescent material emitting light according to the fluorescent phenomena.

8. A fluorescent lamp having two pairs of electrodes, comprising:

a sealed chamber having a gas at a selected pressure therein, said gas including mercury vapor for emitting ultraviolet light when subjected to an electrical field;

a first pair of electrodes adjacent said sealed chamber and positioned to apply an electric field to said gas within said sealed chamber, each of said electrodes being separated from said gas by a dielectric layer;

a second pair of electrodes within said sealed chamber, surrounded by said gas, and positioned to conduct current through said gas within said sealed chamber; and an electric power supply means for providing power to the first and second pair of electrodes, the electric power supply means including a single DC power supply and invertor circuitry to provide AC power to each of said pair of electrodes at different frequencies.

9. The apparatus according to claim 8, further including a plurality of interior walls extending from sidewalls of said sealed chamber to create an interior serpentine shaped chamber having an extended length to create a discharge arc having an extended length.

10. The apparatus according to claim 9, further including a third pair of electrodes within said sealed chamber, surrounded by said gas and positioned to conduct current through said gas within said sealed chamber, said third pair of electrodes being of the hot cathode type and second pair of electrodes being of the cold cathode type, wherein said second pair of electrodes of the cold cathode type include planar walls which are vertically oriented with respect to said sealed chamber and being open to expose the interior of the chamber through a light emitting surface of said chamber so that light is emitted by the lamp from between parallel walls of the cold cathode electrodes.

11. A fluorescent lamp having two pairs of electrodes, a cold cathode pair and a hot cathode pair, comprising:

a sealed chamber having a gas at a selected pressure therein, said gas including mercury vapor for emitting ultraviolet light when an electric current passes therethrough;

a plurality of interior walls extending from the sidewall structure into the chamber and terminating within the chamber, the interior walls extending from a top plate of the chamber to a bottom plate of the chamber to define an extended length, serpentine channel region within the sealed chamber;

a first cold cathode located at one end of the serpentine channel region and positioned within the sealed chamber and surrounded by the gas;

a second cold cathode located at the other end of the serpentine channel region within the sealed chamber and surrounded by the gas, the first and second internal cathodes being of the cold cathode type, each of the cold cathodes being constructed of a planar sheet of metal that extends vertically within the chamber, and parallel to the direction that light is emitted from the chamber so that the cold cathodes do not block light emitted from the top plate of the chamber;

a first hot cathode positioned adjacent the first cold cathode, the first hot cathode being alongside the planar sheet of metal and positioned to emit light directly out of the top plate of the chamber; and a second hot cathode positioned adjacent the second cold cathode, the second hot cathode being alongside the planar sheet of metal and positioned to emit light out of the top plate of the chamber.

12. The lamp according to claim 11 wherein each of said cold cathodes are in the shape of a U-shaped metal strip having two parallel surfaces facing each other and extending vertically, parallel to the interior walls such that light is emitted from the lamp in the region between the two parallel plates that face each other.

13. The apparatus according to claim 12 in which the cold cathode includes planar, facing parallel walls positioned adjacent an interior surface of a wall of the chamber, and juxtapositioned along the interior wall such that it is side-by-side with the interior wall and extends in the same place as the interior wall to not prevent light from being emitted from surfaces above and below the interior wall.

14. The apparatus according to claim 12 wherein:

the hot cathode type electrodes are positioned in a partially enclosed relationship with respect to adjacent each of the first and second cold cathodes, respectively, each of the hot electrodes being positioned between the planar facing walls of the cold cathodes, respectively and exposed to the gas within the chamber such that light emitted by the hot electrode and immediately adjacent the hot electrode is emitted from the lamp to prevent a dark spot from being in the lamp adjacent the electrodes at each end of the serpentine chamber, respectively.

15. A combined hot cathode and cold cathode electrode for use in a fluorescent lamp, comprising:

a cold cathode electrode including a planar metal member having an extended surface area in a direction which is parallel to the direction that light is emitted from a lamp in which the cold cathode is positioned; and a hot cathode electrode positioned adjacent the being exposed to view from a light emitting surface of the lamp in which the cathode combination is positioned such that light emitted by the hot cathode is directly emitted from the lamp.

* * * * *

UNITED STATES PATENT AND TRADEMARK OFFICE

CERTIFICATE OF CORRECTION

PATENT NO. : 5,319,282

DATED : June 7, 1994

INVENTOR(S) : Mark D. Winsor

It is certified that error appears in the above-indentified patent and that said Letters Patent is hereby corrected as shown below:

In claim 15, column 22, line 23, after "the" and before "being", please insert --planar surface of the cold cathode, the hot cathode electrode--.

Signed and Sealed this

Twenty-fifth Day of October, 1994

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,319,282

DATED : June 7, 1994

INVENTOR(S) : Mark D. Winsor

It is certified that error appears in the above-identified patent and that said Letters Patent is hereby corrected as shown below:

In column 2, line 30, delete "no" and substitute therefor --not--.

Signed and Sealed this

Thirtieth Day of May, 1995

Bruce Lehman

*Attest:*

BRUCE LEHMAN

*Attesting Officer*

*Commissioner of Patents and Trademarks*